US009610592B2

(12) United States Patent
Heisele et al.

(10) Patent No.: US 9,610,592 B2
(45) Date of Patent: Apr. 4, 2017

(54) NOZZLE DEVICE FOR A SPRAY ARM OF A DISHWASHER

(71) Applicants: Etimex Technical Components GmbH, Rottenacker (DE); BSH Bosch und Siemens Hausgeraete GmbH, Muechen (DE)

(72) Inventors: Bernd Heisele, Sontheim (DE); Klaus-Peter Holstein, Laupheim (DE)

(73) Assignees: BSH Bosch und Siemens Hausgeraete GmbH, Muechen (DE); Etimex Technical Components GmbH, Rottenacker (DE)

( * ) Notice: Subject to any disclaimer, the term of this patent is extended or adjusted under 35 U.S.C. 154(b) by 19 days.

(21) Appl. No.: 13/972,306

(22) Filed: Aug. 21, 2013

(65) Prior Publication Data

US 2014/0054395 A1 Feb. 27, 2014

(30) Foreign Application Priority Data

Aug. 21, 2012 (DE) ..... 10 2012 016 398

(51) Int. Cl.

| | |
|---|---|
| ***B05B 1/14*** | (2006.01) |
| ***B05B 1/02*** | (2006.01) |
| ***A47L 15/42*** | (2006.01) |
| *B05B 1/26* | (2006.01) |

(52) U.S. Cl.

CPC ..... *B05B 1/02* (2013.01); *A47L 15/4278* (2013.01); *B05B 1/26* (2013.01)

(58) Field of Classification Search

CPC ..... B05B 1/02; A47L 15/4278
USPC ..... 239/589, 592, 597, 598, 601
See application file for complete search history.

(56) References Cited

U.S. PATENT DOCUMENTS

| | | | | |
|---|---|---|---|---|
| 2,588,856 | A * | 3/1952 | La Raus | A47L 15/23 134/179 |
| 4,346,849 | A * | 8/1982 | Rood | 239/597 |
| 7,219,849 | B1 * | 5/2007 | Hedger | 239/543 |
| 7,931,754 | B2 * | 4/2011 | Kehl | A47L 15/4282 134/198 |
| 2008/0073451 | A1 * | 3/2008 | Bradbury et al. | 239/599 |
| 2014/0150831 | A1 * | 6/2014 | Forst et al. | 134/172 |

FOREIGN PATENT DOCUMENTS

| | | |
|---|---|---|
| DE | 1 503 792 | 5/1969 |

* cited by examiner

*Primary Examiner* — Jason Boeckmann
(74) *Attorney, Agent, or Firm* — Gerald E. Hespos; Michael J. Porco; Matthew T. Hespos

(57) ABSTRACT

A nozzle device for a spray arm of a dishwasher for spraying cleaning fluid out into a dishwashing space is provided with a fluid outflow surface for the outflow of the cleaning fluid from the nozzle device into the dishwashing space. The fluid outflow surface is configured with two subsurfaces which form an angle smaller than 180°.

15 Claims, 3 Drawing Sheets

NOZZLE DEVICE FOR A SPRAY ARM OF A DISHWASHER

BACKGROUND

1. Field of the Invention

The invention relates to a nozzle device for a spray arm of a dishwasher for spraying cleaning fluid out into a dishwashing space, with a fluid outflow surface for the outflow of the cleaning fluid from the nozzle device.

2. Description of the Related Art

Nozzles or nozzle devices, by means of which a fluid jet of compact directed form is achieved, are usually provided on spray arms of present-day dishwashers. Such a fluid jet, although highly suitable for releasing, even mechanically, impurities on dishes to be cleaned, nevertheless at the same time generates loud noises when it impinges onto the washware and onto outer walls of the associated dishwashing container.

The fan nozzles, by means of which a comparatively broadly fanned spray jet extending essentially in one plane can be generated, are basically known from other technical sectors. In this regard, the fan nozzles are configured with a narrow gap or slit, through which the cleaning fluid to be sprayed out is pressed out of the spray arm. This slit-shaped geometry of a fluid outflow surface on the nozzle device has the disadvantage that the nozzle device is blocked comparatively easily and is therefore susceptible to soiling.

SUMMARY OF THE INVENTION

According to the invention, a nozzle device for a spray arm of a dishwasher for spraying cleaning fluid out into a dishwashing space is provided, which has a fluid outflow surface or fluid outflow orifice for the outflow of the cleaning fluid from the nozzle device. The fluid outflow surface is configured with two subsurfaces which form an angle smaller than 180°.

By means of the nozzle device according to the invention, the abovementioned risk of blockage of the fluid outflow surface is avoided entirely. According to the invention, the fluid outflow surface is configured with two subsurfaces which can individually have a comparatively large configuration and direct the fluid jet flowing through them in that they are oriented or pivoted at an angle smaller than 180° with respect to one another. Two subjects thus flow out through the two subsurfaces according to the invention, are deflected opposite to one another in front of the nozzle device and are consequently deformed into a fine-shaped overall jet. Thus, overall, a fine jet is generated which leads to a reduction in the washing noise of the dishwasher of this type, while at the same time improving the dish cleaning performance and container self-cleaning.

The angle which the two subsurfaces of the nozzle device according to the invention form is preferably configured smaller than 150°, in particular smaller than 100°. Especially preferably, the angle which the two subsurfaces form is configured between 95° and 85°, preferably as 90°. The angles thus selected lead, particularly when the cleaning fluid is washing liquor, to a flow situation in front of the nozzle device according to the invention which gives rise to broad lateral fanning open, at the same time with advantageous atomization of the fluid droplets in the jet.

Furthermore, in the nozzle device according to the invention, the two subsurfaces are preferably configured to be of the same size. This form of the subsurfaces leads to two identically strong substreams which are subsequently directed opposite to one another and consequently result in a single overall jet which is advantageously fanned open. By the subsurfaces being of the same size, the main outflow direction resulting for the overall jet can be predefined in a simple way as the middle of the abovementioned angle (bisecting line). A spray pattern can thereby be predefined in a simple way in the dishwashing space.

At least one of the two subsurfaces is preferably configured with a rectangular shape. A rectangular shape of this kind leads, particularly at the marginal regions of the overall jet generated according to the invention, to an especially advantageous jet form.

In this development, especially preferably, both subsurfaces are configured with a rectangular shape and the two rectangular shapes are formed in each case by a leg piece, the leg pieces of the two subsurfaces being configured with a differing length. According to the invention, by means of rectangular subsurfaces configured with a differing length in this way, two subjects directed laterally to a differing extent can be deflected opposite one another and at the same time are combined into an obliquely deflected fanned-open overall jet. The overall jet is, in particular, deflected toward that side which has the shorter leg piece. By means of differently configured surface shapes, in particular rectangular shapes, for the individual subjects, the orientation of even a large number of jets in the dishwashing space can thus be determined very simply. Orientation can in this case be defined very simply and accurately for example, such that, by means of the fluid jets which arise, the associated spray arm is set actively in rotation, particularly about a central axis. Alternatively, the subsurfaces advantageously have, in particular, a semi-oval configuration or a configuration as a regular paragon.

Furthermore, in the nozzle device according to the invention, advantageously a fluid duct is provided, by means of which the cleaning fluid can be deflected from a main delivery direction along a spray arm toward the fluid outflow surface. In this case, the fluid duct is delimited by fluid duct surfaces, a first fluid duct surface of which is oriented at an angle of 30° to 60°, preferably at 45°, to the main delivery direction. Furthermore, the fluid duct is preferably delimited by a second fluid duct surface which lies opposite the fluid duct surface and which is oriented at an angle of 0° to 60°, preferably at 45°, to the main delivery direction. Finally, moreover, the fluid duct is preferably also delimited by a third fluid duct surface which is contiguous to the first fluid duct surface and which is oriented parallel to the main delivery direction. Such a configuration of a fluid duct in the flow direction shortly before the fluid outflow surface according to the invention is reached leads to a fluid flow having comparatively low turbulence. This also gives rise, downstream of the fluid outflow surface in the flow direction, to an easily orientable and uniformly fanned-open cleaning jet.

The invention is also aimed especially at the use of such a nozzle device according to the invention on a spray arm of a dishwasher for spraying cleaning fluid out into a dishwashing space.

Exemplary embodiments of the solution according to the invention are explained in more detail below.

DETAILED DESCRIPTION OF THE PREFERRED EMBODIMENTS

Figure 1:
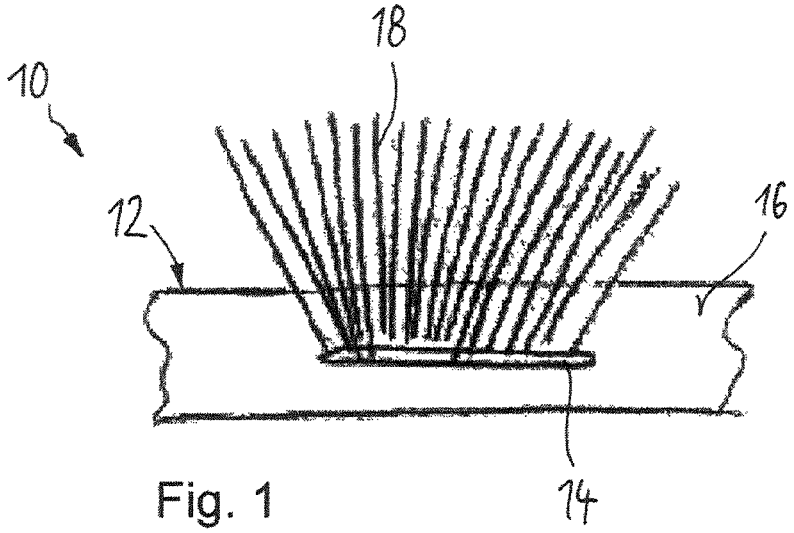
Fig. 1 Prior Art
FIG. 1 shows a perspective view of a nozzle device for a spray arm of a dishwasher according to the prior art.

FIG. 1 illustrates a nozzle device 10 on a spray arm 12 according to the prior art. The nozzle device 10 is configured with a slit 14, as a fluid outflow surface, which is formed in a top side 16 of the spray arm 12. A cleaning fluid, in the present case, in particular, water, is delivered at a pressure of approximately 4 bar to the slit 14 from inside the spray arm 12. The cleaning fluid flows outward from the spray arm 12 through the slit 14 and at the same time forms a spray jet 18 fanned open to the width of the slit 14. The form of the fanned jet of this kind is generated on account of the elongate configuration of the slit 14 when the cleaning fluid flows through the slit 14. Outside the slit 14, the spray jet 16 is not influenced any further. In particular, as is explained in more detail below, the spray jet 16 therefore has, inter alia, a comparatively large droplet size.

Figure 2:
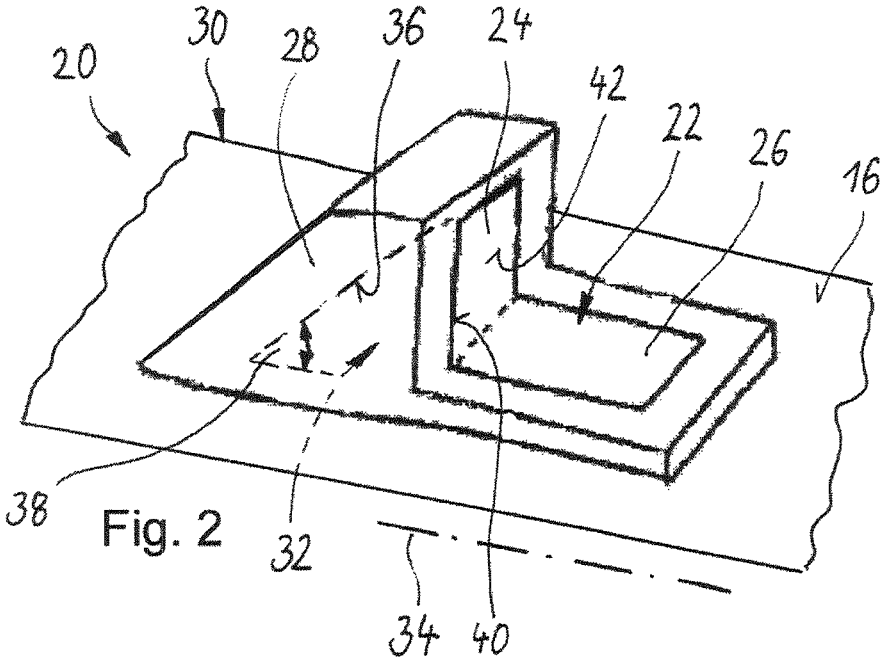
FIG. 2 shows a perspective view of a first exemplary embodiment of a nozzle device for a spray arm of a dishwasher according to the invention.
Figure 3:
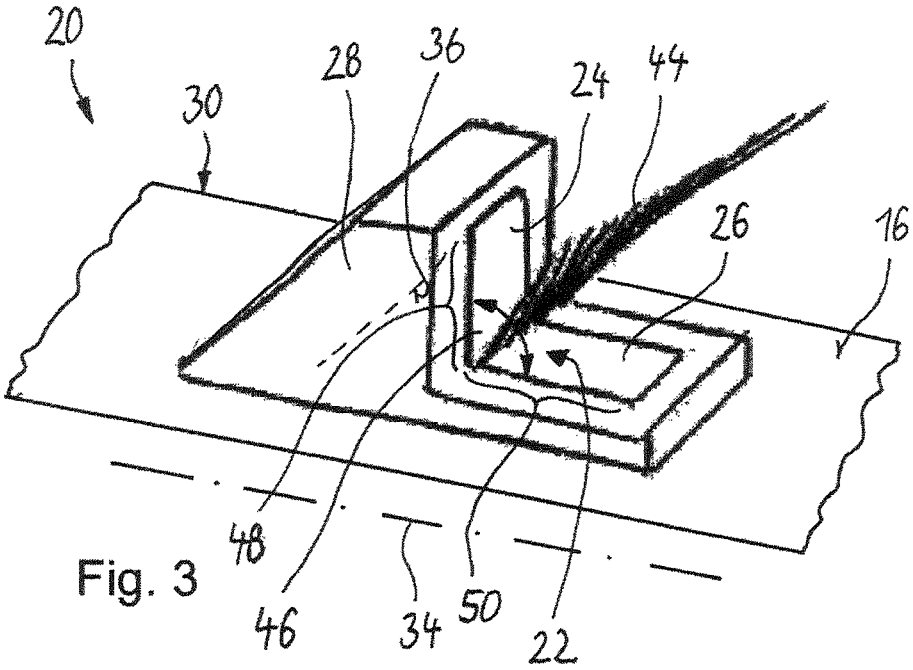
FIG. 3 shows the view according to FIG. 2 with a fluid jet generated by a nozzle device.
Figure 4:
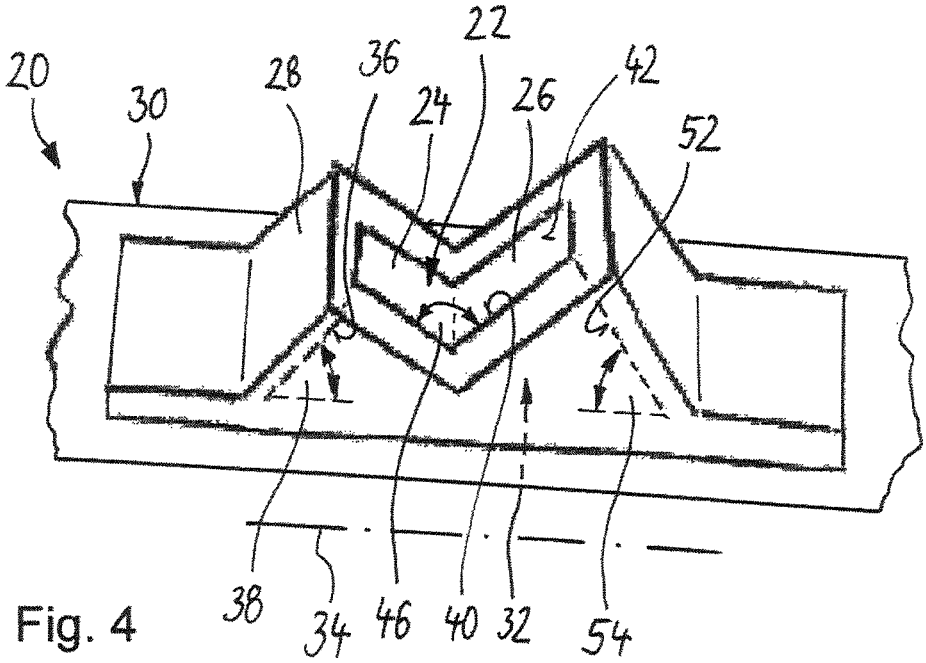
FIG. 4 shows a perspective view of a second exemplary embodiment of a nozzle device for a spray arm of a dishwasher according to the invention.
Figure 5:
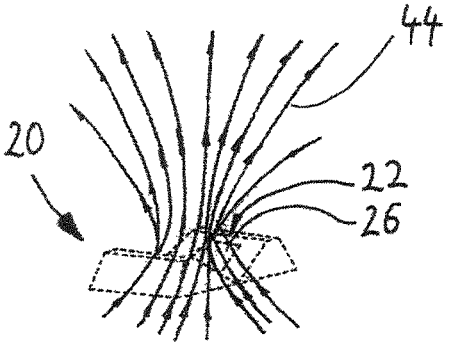
FIG. 5 shows a further perspective view of a nozzle device corresponding to FIG. 4 with an illustration of the basic generation of the associated spray jet.
Figure 6:
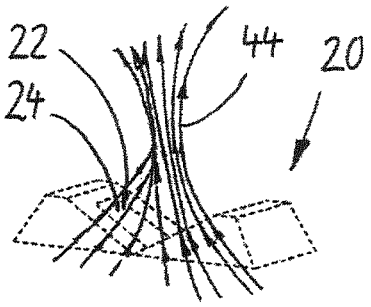
FIG. 6 shows a further perspective view of the illustration according to FIG. 5.
Figure 7:
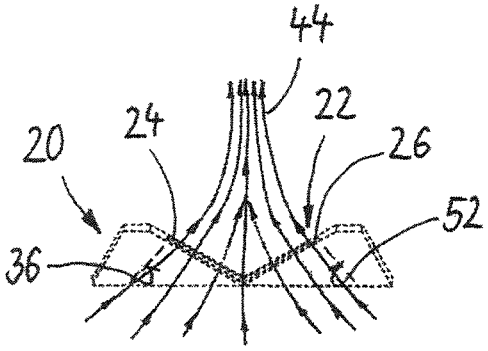
FIG. 7 shows a side view of the illustration according to FIG. 5.
Figure 8:
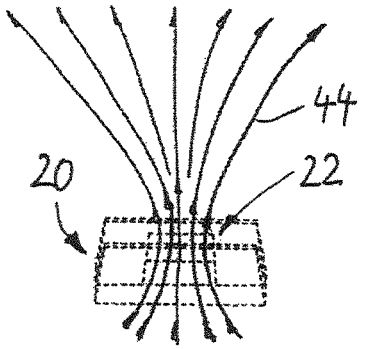
FIG. 8 shows a front view of the illustration according to FIG. 5.

FIG. 2 to 4 show exemplary embodiments of nozzle devices 20 according to the invention. In the nozzle device 20 according to FIGS. 2 and 3, a fluid outflow surface 22 for the outflow or emergence of the cleaning fluid outwardly is provided, which is configured with two subsurfaces 24 and 26. The fluid outflow surface 22 with its two subsurfaces 24 and 26 is formed by a fluid duct housing 28 which is inserted into an associated spray arm 30.

The fluid duct housing 28 encloses a fluid duct 32, by means of which the cleaning fluid is deflected from a main delivery direction 34 along the spray arm 30 toward the fluid outflow surface 22.

The fluid duct 32 is delimited by a first fluid duct surface 36 which is oriented at an angle of 38 to 45° to the main delivery direction 34 and which in this case directs the delivered cleaning fluid obliquely outward from inside the spray arm 30. Two further fluid duct surfaces 40 and 42 are contiguous to the fluid duct surface 36 on both sides of the latter. These two fluid duct surfaces 40 and 42 are oriented parallel to the main delivery direction 34. The fluid duct 32 thus configured leaves, directly or shortly before the fluid outflow surface 32 is reached in the flow direction, to a fluid flow of comparatively low turbulence and consequently directs a largely laminar-flowing spray jet 44 through the fluid outflow surface 22.

Furthermore, in the area of the fluid outflow surface 22, the fluid duct surfaces 36, 40 and 42 delimit the two subsurfaces 24 and 26 in such a way that these form an angle 46 of 90°. The fluid outflow surface 22 of this kind forms with its two subsurfaces 24 and 26 two subjects which are deflected opposite to one another in front of the nozzle device 20 and at the same time are deformed into a fan-shaped overall jet in the form of the spray jet 44 illustrated in FIG. 3.

In the exemplary embodiment according to FIGS. 2 and 3, the two subsurfaces 24 and 26 are configured with different size, these being formed in each case as a rectangular surface with leg pieces 48 and 50 of different lengths. In this case, the leg piece 50 of the second subsurface 26 is longer than the leg piece 48 of the first subsurface 24. Since the subsurfaces 24 and 26 are in this case of identical width, the rectangular area of the second subsurface 26 is also larger than that of the first subsurface 24. At the same time, the subject through the second subsurface 26 is also designed to be stronger than the subject through the first subsurface 24. Since the subjects converge in this way in front of the nozzle device 20, an overall jet is obtained which forms an angle of approximately 60° to the main delivery direction 24. The spray jet 44 of this kind is therefore directed upward more steeply than the first fluid duct surface 36.

In the exemplary embodiment according to FIG. 4, the fluid outflow surface 22 designed to be angled with two subsurfaces 24 and 26 is tilted at the fluid duct 32 in the direction of the first fluid duct surface 36. In this case, opposite this fluid duct surface 36, a further fluid duct surface 52 is provided which is oriented at an oppositely directed angle 54 of likewise 45° to the main delivery direction. At the same time, the two, likewise rectangular subsurfaces 24 and 26 are configured to be of the same size. A nozzle device 20 is thus provided, the spray jet of which flows out essentially perpendicularly to the main delivery direction 34.

FIG. 5 to 8 illustrate once again the principle of the deflection of two subjects opposite to one another by means of the fluid outflow surface 22. The fluid outflow surface 22 generates with its two subsurfaces 24 and 26 two subjects which are deflected opposite to one another in the nozzle device 20 by the fluid duct surfaces 36 and 52 an at the same time are deformed into a fan-shaped overall jet in the form of the fan-shaped spray jet 44. As a result, a fan jet is generated which leads to a reduction in the washing noise in the associated dishwasher, while at the same time improving the dish cleaning performance and container self-cleaning. In particular, broad lateral fanning open, at the same time with advantageous atomization of the fluid droplets in the spray jet 44, is achieved. This atomization is based on the fact that the two subsurfaces are directed obliquely opposite to one another by the fluid outflow surface 22 and its two subsurfaces 24 and 26 (see, in particular, FIGS. 6 and 7) and the droplets are thereby knocked against one another. The droplets are thus atomized and, furthermore, are at the same time moved to the side.

In conclusion, it should be noted that all the features mentioned in the application documents and, in particular, in the dependent claims are to have independent protection, even individually or in any desired combination, in spite of a formal reference made back to one or more specific claims.

What is claimed is:

1. A nozzle device (20) for a spray arm (30) of a dishwasher for spraying cleaning fluid out into a dishwashing space, the spray arm (30) delivering the cleaning fluid along a main delivery direction (34) defined by the spray arm (30), the nozzle device (20) comprising: a fluid outflow opening (22) for an outflow of the cleaning fluid from the nozzle device (20), the fluid outflow opening (22) being formed in two subsurfaces (24, 26) that intersect at a concave angle (46) smaller than 180° so that the two subsurfaces (24, 26) diverge from one another in a downstream direction of the cleaning fluid sprayed from the nozzle device (20), an area of the outflow opening (22) in at least one of the two subsurfaces (24, 26) having a rectangular shape, the nozzle device (20) further having a fluid duct (32) aligned for deflecting the cleaning fluid from the main delivery direction (34) to the fluid outflow opening (22), the fluid duct (32) being delimited by a plurality of fluid duct surfaces (36, 40, 42, 52) on an interior of the nozzle and communicating with areas external of the nozzle via the fluid outflow opening (22), the fluid duct surfaces (36, 40, 42, 52) including a first fluid duct surface (36) oriented at an angle of 30° to 60° to the main delivery direction (34) so that the first fluid duct surface (36) directs the cleaning fluid obliquely outward from inside the spray arm (30).

2. The nozzle device of claim 1, wherein the angle (46) formed by the two subsurfaces (24, 26) is smaller than 150°.

3. The nozzle device of claim 2, wherein the angle (46) formed by the two subsurfaces (24, 26) is between 95° and 85°.

4. The nozzle device of claim 1, wherein areas of the fluid outflow opening in each of the two subsurfaces (24, 26) are of equal size.

5. The nozzle device of claim 1, wherein both of the subsurfaces (24, 26) have rectangular shapes and the two rectangular shapes are formed respectively by leg pieces (48, 50), the leg pieces (48, 50) of the two subsurfaces (24, 26) having different lengths.

6. The nozzle device of claim 1, wherein the fluid duct (32) is delimited by a second fluid duct surface (52) opposite the first fluid duct surface (36) and oriented at angle of 0° to 60° to the main delivery direction (34), the first and second fluid duct surfaces (36, 52) converging toward one another at distances farther from the spray arm (30).

7. The nozzle device of claim 6, wherein the fluid duct (32) is delimited by at least one third fluid duct surface (40, 42) contiguous to the first fluid duct surface (36) and oriented parallel to the main delivery direction (34).

8. A spray arm (30) of a dishwasher for spraying cleaning fluid out into a dishwashing space, the spray arm (30) comprising the nozzle device of claim 1.

9. The nozzle device of claim 1, wherein the fluid duct (32) is delimited further by at least one contiguous fluid duct surface (40, 42) that is contiguous to the first fluid duct surface (36) and oriented parallel to the main delivery direction (34).

10. The nozzle device of claim 9, wherein the at least one contiguous fluid duct surface (40, 42) comprises two opposed contiguous fluid duct surfaces (40, 42) oriented parallel to one another.

11. A nozzle device (20) for a spray arm (30) of a dishwasher for spraying cleaning fluid out into a dishwashing space, the spray arm (30) delivering the cleaning fluid along a main delivery direction (34) defined by the spray arm (30), the nozzle device (20) comprising: a fluid outflow opening (22) for an outflow of the cleaning fluid from the nozzle device (20), the fluid outflow opening (22) being formed in two subsurfaces (24, 26) that intersect at a concave angle (46) smaller than 180° so that the two subsurfaces (24, 26) diverge from one another in a downstream direction of the cleaning fluid sprayed from the nozzle device (20), an area of the outflow opening (22) in at least one of the two subsurfaces (24, 26) having a rectangular shape, the nozzle device (20) further having a fluid duct (32) aligned for deflecting the cleaning fluid from the main delivery direction (34) defined by the spray arm (30) to the fluid outflow opening (22), the fluid duct (32) being delimited by a plurality of fluid duct surfaces (36, 40, 42, 52) on an interior of the nozzle and communicating with areas external of the nozzle via the fluid outflow opening (22), the fluid duct surfaces (36, 40, 42, 52) including a first fluid duct surface (36) disposed to intersect a surface inside the spray arm (30) along which the cleaning fluid is directed, and with the first fluid duct surface (36) being oriented at a selected angle in a range in of 30° to 60° to the main delivery direction (34) defined by the spray arm (30) so that the first fluid duct surface (36) directs the cleaning fluid obliquely outward from inside the spray arm (30) in directions oblique to the main delivery direction defined by the spray arm (30).

12. The nozzle device of claim 11, wherein the fluid duct (32) is delimited by a second fluid duct surface (52) opposite the first fluid duct surface (36) and oriented at angle of 0° to 60°, to the main delivery direction (34), the first and second fluid duct surfaces (36, 52) converging toward one another at distances farther from the spray arm (30).

13. The nozzle device of claim 12, wherein the fluid duct (32) is delimited by at least one third fluid duct surface (40, 42) contiguous to the first fluid duct surface (36) and oriented parallel to the main delivery direction (34).

14. The nozzle device of claim 11, wherein the fluid duct (32) is delimited further by at least one contiguous fluid duct surface (40, 42) that is contiguous to the first fluid duct surface (36) and oriented parallel to the main delivery direction (34).

15. The nozzle device of claim 14, wherein the at least one contiguous fluid duct surface (40, 42) comprises two opposed contiguous fluid duct surfaces (40, 42) oriented parallel to one another.

* * * * *